US008172479B2

(12) United States Patent
Dawson et al.

(10) Patent No.: US 8,172,479 B2
(45) Date of Patent: May 8, 2012

(54) COMPOSITION FOR SEALING JOINTS IN ROAD SURFACES AND SUBSURFACES

(75) Inventors: Delbert L. Dawson, Mansfield, OH (US); Colin Durante, Mansfield, OH (US)

(73) Assignee: D&D Emulsions, Inc., Mansfield, OH (US)

( * ) Notice: Subject to any disclaimer, the term of this patent is extended or adjusted under 35 U.S.C. 154(b) by 0 days.

(21) Appl. No.: 13/048,800

(22) Filed: Mar. 15, 2011

(65) Prior Publication Data

US 2011/0166266 A1 Jul. 7, 2011

Related U.S. Application Data

(63) Continuation of application No. 12/315,586, filed on Dec. 4, 2008, now Pat. No. 7,927,038.

(51) Int. Cl.
*C08L 95/00* (2006.01)

(52) U.S. Cl. ..... 404/107; 524/64

(58) Field of Classification Search ..... 404/17, 404/32, 47, 75, 107; 524/64
See application file for complete search history.

(56) References Cited

U.S. PATENT DOCUMENTS

| | | | | | |
|---|---|---|---|---|---|
| 3,763,074 | A * | 10/1973 | Rostler | 524/475 |
| 3,900,692 | A * | 8/1975 | Rostler | 428/489 |
| 4,017,446 | A | 4/1977 | Rion | |
| 4,021,393 | A * | 5/1977 | McDonald | 524/64 |
| 4,358,554 | A * | 11/1982 | Yan et al. | 524/69 |
| 4,745,155 | A * | 5/1988 | Grossi | 525/54.5 |
| 4,784,518 | A * | 11/1988 | Cutler | 404/79 |
| 5,180,428 | A * | 1/1993 | Koleas | 106/277 |
| 5,439,313 | A * | 8/1995 | Blaha et al. | 404/75 |
| 6,315,492 | B1 * | 11/2001 | McIntosh | 404/17 |
| 7,357,594 | B2 * | 4/2008 | Takamura | 404/75 |
| 2005/0215673 | A1 | 9/2005 | Takamura | |
| 2006/0104716 | A1 * | 5/2006 | Jones | 404/77 |
| 2009/0092846 | A1 * | 4/2009 | Takamura et al. | 428/480 |

* cited by examiner

*Primary Examiner* — Raymond W Addie
(74) *Attorney, Agent, or Firm* — Carr & Ferrell LLP

(57) ABSTRACT

A composition that may be used to seal and strengthen the joints in an asphalt road surface and subsurface to prolong the useful life of the road is disclosed herein. The composition utilizes a polymer modified cationic maltene emulsion containing polymer modified maltene oils and resins, and surfactants/and wetting agents. The emulsion is applied to the longitudinal joints and other joints in the asphalt pavement surface. The emulsion reduces voids in the asphalt pavement and chemically improves the asphalt binder properties, thereby altering the modulus of elasticity of the asphalt binders so that the resistance of the pavement to tension is increased, and the water absorption of the pavement is reduced.

5 Claims, No Drawings

COMPOSITION FOR SEALING JOINTS IN ROAD SURFACES AND SUBSURFACES

CROSS-REFERENCE TO RELATED APPLICATIONS

The present application is a continuation application and claims the priority benefit of U.S. patent application Ser. No. 12/315,586, filed on Dec. 4, 2008, and titled "Method of Sealing Joints in Road Surfaces and Subsurfaces," issued as U.S. Pat. No. 7,927,038, on Apr. 19, 2011, which is incorporated herein by reference. U.S. patent application Ser. No. 12/315,586 is a continuation application and claims the priority benefit of U.S. patent application Ser. No. 11/483,282, filed on Jul. 7, 2006, and titled "Method of Sealing Joints In Road Surfaces and Subsurfaces," which is also incorporated herein by reference.

BACKGROUND OF THE INVENTION

1. Field of the Invention

The present invention relates generally to road construction. The present invention is more particularly a composition for prolonging the useful life of a road surface by sealing and strengthening the joints created during the paving process.

2. Description of the Prior Art

Highway paving is a huge industry. There are over 2.5 million miles of paved roads in the United States alone. Depending on the weather and level of usage the road surface may have to be repaired or replaced every 3-5 years. This represents a huge financial burden on the entity responsible for road maintenance.

One of the chief factors leading to premature road surface breakdown is cracking and disintegration around the joints between the sections (lanes) of asphalt pavement. There are two main causes leading to the formation of cracks in the joints between the lanes of asphalt pavement. The first area of premature deterioration causation is the temperature effect. First, the asphalt pavement shrinks as the ambient temperature drops during a seasonal temperature change. Asphalt pavements are strong when subjected to compressive loads; however, asphalt pavements do not have nearly as much resistance when subjected to tension (pulling apart) forces. The tension created by shrinkage, which occurs when the temperature decreases, is therefore very damaging to an asphalt surface, particularly around the joints. Second, the asphalt binder or glue used in the pavement deteriorates when subjected to heat. The manufacturing process used to make asphalt paving mixture by necessity subjects the asphalt binder material to high heat. Summer temperatures also heat the asphalt and contribute to the deterioration of the asphalt binder material, thereby reducing the resistance of the asphalt to stress, particularly to tension forces. The effects of the reduced resistance of the asphalt to cracking are most prevalent at the joint areas, where the asphalt pavement matrix is weakest.

The second chief cause of premature deterioration is the lack of compaction at the edges of a given asphalt pavement section. The area at and adjacent to the longitudinal joint of two asphalt highway lanes is difficult to compact during initial construction. The area to either side of the longitudinal joint (roughly plus or minus one foot from the joint) has less density or compaction than the balance of the pavement. The problem then is water and air intrusion into the area that is not as highly compacted. Water strips the asphalt coating from the asphalt pavement aggregate, thereby weakening the bond between coated aggregate pieces. In addition water absorbed in the critical non-compacted area freezes in winter conditions, causing mechanical damage to the area. Air entry into the pavement structure accelerates oxidation of the asphalt binder reducing its glue-like properties.

There is a need for a composition that will seal joints in asphalt surfaces, thereby prolonging the useful life of the surface.

SUMMARY OF THE INVENTION

The composition disclosed herein is a non-asphalt emulsion adapted for sealing joints in an asphalt pavement surface. The emulsion includes at least one polymer modified maltene oil, at least one polymer modified maltene resin, and at least one surfactant/wetting agent.

The emulsion includes milled particles. The milled particles are prepared with a heated milling process so that particle sizes in the emulsion are increased by the heating. When the particles have cooled, the resultant particle size is less than a mill setting. The application of the emulsion to an asphalt surface alters the modulus of elasticity of the binders of the asphalt surface by filling voids in the asphalt pavement surface material.

When the emulsion is applied to the asphalt pavement, the emulsion combines with at least one binder in the asphalt pavement to create a rubberized sealant.

DETAILED DESCRIPTION OF THE INVENTION

The present invention is a non-asphalt emulsion formulated to seal and strengthen the joints in an asphalt road surface and subsurface to prolong the useful life of the road. The emulsion may be formed from a polymer modified cationic maltene emulsion containing polymer modified maltene oils and resins, surfactants, and wetting agents.

The emulsion is applied to the longitudinal joints in the asphalt surface. When an asphalt road is constructed, the area around the center longitudinal joint or joints is difficult to properly compact. The joint itself, and a surrounding band approximately a foot wide on either side of the joint, cannot be compacted as thoroughly as the main body of the asphalt pavement. The asphalt pavement in the joint area is more porous than the other areas of the asphalt pavement, and is therefore more susceptible to water permeation, oxidation, and tension force damage.

The emulsion is typically sprayed onto the road surface. A spray bar two to three feet wide and two to three inches in diameter, with one-eighth inch nozzles is used in the preferred embodiment to spray the emulsion onto the road surface. The application rate is controlled by a computerized flow manager, which allows the emulsion to be precisely applied to the joint area of the road surface. Once the flow rate computer has been set to the desired application rate, the application of the emulsion is very accurate due to the computer control of the flow, regardless of travel speed variations of the sprayer. Because the joint area is less compacted than the main part of the road surface, the application rate necessary for the joint area is much higher than could be absorbed in the main surface area. For this reason, conventional application methods cannot be used to effectively seal the joint area. Using conventional methods that cover the entire width of the road, if the flow rate is made high enough to seal the voids in the joint area, the main road surface cannot absorb the emulsion.

While the preferred embodiment of the invention uses an automated sprayer to apply the emulsion, any means suitable for application of a liquid emulsion could be effectively used provided the required accuracy of application is maintained.

After it has been applied to the asphalt pavement, the emulsion of the present invention reduces the voids in the asphalt pavement, both on the top surface and beneath the surface. The emulsion may alter the modulus of elasticity of the binders in the asphalt pavement mixture, strengthening the asphalt binders and introducing rubber-like properties to the surface and below the surface throughout the joint area and the bordering band where the emulsion is applied. The increased elasticity of the asphalt pavement increases its resistance to tension forces. The application of the emulsion also reduces the water absorption of the asphalt pavement. These two factors, tension damage and water permeation, are the chief components of premature asphalt surface damage.

The emulsion is formed from selected oils and resins extracted from a crude oil source, with a rubber component added after the emulsion has been prepared. The base oil of the emulsion is a petroleum resin. In the preferred embodiment, Petroleum Resin C.A.S. 64742-04-7 or 64742-11-6 is chosen. The base resin is mixed with water, emulsifiers, and a polymer compound. In the preferred embodiment the polymer compound is Surfonic NPB95 or Witcolnol NP-100, and the emulsifier is E-11 Redicote or AA-57. The emulsion comprises, as a percentage by weight, approximately 58% petroleum resin, 36.75% water, 3% polymer compound, and 2.25% emulsifier.

The emulsion is prepared so as to minimize the particle size in order to give the emulsion maximum penetrating capability. The components are mixed in a colloid mill that provides for a particle size setting of 0.018-0.025. However, milling alone will not provide optimal preparation of the emulsion. The base oil is heated to 200°-208° F. to increase the volume. The water is heated to 100°-120° F. The heating causes the particles to expand. The colloid mill setting is therefore applied to an increased particle size. When the mixture is cooled to ambient temperature, the particle size of the emulsion is reduced to less than the original mill setting. In order to give the emulsion more rubber-like properties, rubber in the amount of 2% by volume is added to the emulsion. The rubber chosen for the preferred embodiment is styrene butadiene polymer, or unvulcanized synthetic virgin rubber.

The process of the present invention has shown excellent performance in field testing. In a first test application, the emulsion of the present invention was applied to alternating sections of a new construction asphalt road surface. The untreated sections of the road surface served as control areas. The emulsion was applied to 300 foot long sections two feet wide centered on the longitudinal joint. The application rate was 0.10 gallons per square yard. After three years, visual inspection was made of the test surface. Photographic records show marked differences in the condition of the treated and untreated areas of the surface. Those areas adjacent to the joints that were treated with the emulsion equaled or exceeded the performance of the highly compacted areas of the road surface away from the longitudinal joint. Those areas adjacent the joint that were not treated with the emulsion showed significant deterioration that required repair or replacement.

The above disclosure is not intended as limiting. Those skilled in the art will readily observe that numerous modifications and alterations of the device may be made while retaining the teachings of the invention. Accordingly, the above disclosure should be construed as limited only by the restrictions of the appended claims.

What is claimed is:

1. A non-asphalt emulsion adapted for sealing joints in an asphalt pavement surface comprising:

at least one polymer modified maltene oil;

at least one polymer modified maltene resin; and at least one surfactant/wetting agent, wherein the emulsion comprises at least 50% petroleum resin, approximately 36% water, approximately 3% polymer compound, and approximately 2% emulsifier as weight percentages.

2. The emulsion of claim 1, wherein the emulsion is combined with at least one binder in the asphalt pavement to create a rubberized sealant.

3. The emulsion of claim 1, further comprising milled particles, wherein a finished particle size of at least some milled particles in the emulsion is less than a minimum mill setting.

4. The emulsion of claim 1, wherein the emulsion alters the modulus of elasticity of the binders of the asphalt surface by filling voids in the asphalt pavement surface material.

5. The emulsion of claim 3, wherein the emulsion alters the modulus of elasticity of the binders of the asphalt surface by filling voids in the asphalt pavement surface material.

* * * * *